US006598702B1

(12) United States Patent
McGillewie, Jr. et al.

(10) Patent No.: US 6,598,702 B1
(45) Date of Patent: Jul. 29, 2003

(54) UNDER BRIDGE ACCESS APPARATUS WITH CROSS-LINKING MEMBER CONNECTING TOWER WITH VEHICULAR CHASSIS

(76) Inventors: Garth E. McGillewie, Jr., 14617 Ballantyne Country Club Dr., Charlotte, NC (US) 28277; Garth E. McGillewie, Sr., 120 Tall Pines Ct., Lake Wylie, SC (US) 29710

( * ) Notice: Subject to any disclaimer, the term of this patent is extended or adjusted under 35 U.S.C. 154(b) by 0 days.

(21) Appl. No.: 09/615,937

(22) Filed: Jul. 13, 2000

(51) Int. Cl.[7] ..... E04G 1/36
(52) U.S. Cl. ..... 182/2.6; 182/62.5
(58) Field of Search ..... 182/2.6, 2.7, 2.9, 182/62.5, 65.1, 69.1, 69.5, 63.1

(56) References Cited

U.S. PATENT DOCUMENTS

| | | | | |
|---|---|---|---|---|
| 159,571 | A | * | 2/1875 | Schmid ..... 182/62.5 |
| 686,458 | A | * | 11/1901 | Johnson |
| 925,922 | A | * | 6/1909 | Knapke et al. |
| 2,669,490 | A | | 2/1954 | Kaufman |
| 3,085,648 | A | | 4/1963 | Benedetto |
| 3,262,517 | A | | 7/1966 | Malec |
| 3,352,380 | A | | 11/1967 | Barney |
| 3,357,517 | A | | 12/1967 | Wagner |
| 3,456,756 | A | | 7/1969 | Price |
| 3,556,250 | A | | 1/1971 | Miele |
| 3,608,669 | A | | 9/1971 | Lindsay, Jr. |
| 3,687,321 | A | * | 8/1972 | Goodhart |
| 3,774,719 | A | | 11/1973 | Lindsay, Jr. |
| 4,074,790 | A | | 2/1978 | Colbachini et al. |
| 4,154,318 | A | | 5/1979 | Malleone |

(List continued on next page.)

OTHER PUBLICATIONS

Hydra Platforms Model HPT–15/15 Truck Mounted Model Speciications.

Hydra Platforms Model HP–32—Hydra Platforms—Specifications.

*Primary Examiner*—Alvin Chin-Shue
(74) *Attorney, Agent, or Firm*—Kennedy Covington Lobdell & Hickman, LLP

(57) ABSTRACT

An under bridge access vehicle includes a tower having a ladder section and a platform section, and a vehicular chassis including a turntable mounted on the vehicular chassis for rotation thereabout and a tiltable frame mounted on the turntable in pivotal disposition relative thereto. A cross-linking member, including a pair of elongate arms pivotally joined intermediate respective lengths thereof, extends between and connects together the tiltable frame and tower. Specifically, a first of the arms includes an end mounted at a fixed location on the tiltable frame and another end slidably mounted on the ladder section, and a second of the arms including an end slidably mounted on the tiltable frame and another end slidably mounted on the ladder section, with each said arm extending between and being pivotally connected to the respective ends thereof. A first cylinder interconnects the tiltable frame and cross-linking member whereby the tower is movable between a retracted position and an extended position. A second cylinder interconnects the ladder section and the end of the first arm slidably mounted to the tower whereby the ladder section is slidable between upper and lower positions. A catwalk extends between the tower and the base and includes a first walkway mounted in fixed disposition to the tiltable frame and a second walkway mounted to the end of the second arm that is slidably mounted to the ladder section. The first walkway and second walkway subsequently move only linearly relative to each other.

18 Claims, 9 Drawing Sheets

U.S. PATENT DOCUMENTS

| | | | | | |
|---|---|---|---|---|---|
| 4,461,369 | A | | 7/1984 | Amador | |
| 4,556,124 | A | | 12/1985 | Lotto | |
| 4,624,340 | A | | 11/1986 | Astrom et al. | |
| 4,633,975 | A | | 1/1987 | Connor et al. | |
| 4,646,875 | A | | 3/1987 | Sholl | |
| 4,684,314 | A | * | 8/1987 | Luth | |
| 4,690,247 | A | | 9/1987 | Yoshida | |
| 4,696,371 | A | | 9/1987 | Moog | |
| 4,893,696 | A | | 1/1990 | Moog | |
| 5,253,731 | A | | 10/1993 | Moog | |
| 5,318,149 | A | | 6/1994 | Moog | |
| 5,435,410 | A | | 7/1995 | Langston | |
| 5,755,306 | A | * | 5/1998 | Kraemer et al. | 182/148 |

* cited by examiner

UNDER BRIDGE ACCESS APPARATUS WITH CROSS-LINKING MEMBER CONNECTING TOWER WITH VEHICULAR CHASSIS

FIELD OF THE PRESENT INVENTION

The present invention relates to under bridge access apparatus and, more particularly, to an under bridge access apparatus having a cross-linking member connecting together a tower with a vehicular chassis.

BACKGROUND OF THE PRESENT INVENTION

An "under bridge access apparatus" commonly comprises a hydraulically-operated mechanism mounted onto a vehicular chassis, such as that of a truck or trailer. The mechanism is hydraulically foldable into a compactly retracted storage/transport position and hydraulically extendable, when situated on a bridge or similar structure, to extend over and down from a bridge railing and then under the bridge to provide a platform on which workers can stand while performing maintenance, repair and like operations.

Various conventional under bridge access apparatus are well-known and, for example, include those disclosed by U.S. Pat. Nos. 2,669,490; 3,085,648; 3,262,517; 3,357,517; 3,456,756; 3,608,669; 3,774,719; 4,074,790; 4,154,318; 4,461,369; 4,556,124; 4,624,340; 4,633,975; 4,646,875; 4,690,247; 4,893,696; 4,696,371; 5,253,731; 5,318,149; and 5,435,410.

A particular conventional under bridge access apparatus sold by Hydra Platforms MFG., Inc., of Charlotte, N.C., as Model HPT-15/50 has met with commercial success. This apparatus includes a tower and vehicular chassis. The chassis includes a rotatable base mounted thereon and a tiltable frame pivotally mounted to the base. A catwalk extends between and rigidly connects the tiltable frame to the tower. The tower itself includes a ladder section and a platform section pivotally and rotatably mounted to the ladder section. The tower, originally aligned with and carried over the vehicular chassis, is positioned into a vertical position adjacent a bridge by rotating the base and pivoting the tiltable frame approximately ninety degrees. A drawback to this particular under bridge access apparatus is that the tower is fixed relative to the vehicle when the tower is in the upright position for deployment of the platform section. Accordingly, the tower cannot be laterally adjusted to bring it closer to the bridge and, if such adjustment is absolutely necessary, the vehicle must be repositioned to extend further from the edge of the bridge and further into the road making passing by traveling motor vehicles more hazardous.

A conventional under bridge access apparatus that has met with commercial success and that has solved this problem of lateral adjustment of the tower relative to the vehicular chassis is disclosed by U.S. Pat. No. 5,253,731 to Alfons Moog. Specifically, this particular apparatus utilizes pairs of arms (11,12) to form an adjustable parallelogram for shifting the tower relative to the vehicle (3) and bridge (1). Unfortunately, a significant drawback to this design is that the catwalk, by which a worker accesses the tower (8), necessarily changes pitch between a relatively steep incline and steep decline each time the tower is adjusted, resulting in safety concerns for workers who must cross the catwalk.

The present invention addresses the problem of adjusting the tower relative to the vehicular chassis in the aforementioned apparatus sold by Hydra Platforms MFG., Inc., while avoiding the safety concerns presented by the parallelogram design of the Moog apparatus.

SUMMARY OF THE PRESENT INVENTION

Briefly summarized, the present invention includes an under bridge access apparatus in which a cross-linking member connects a tower with a vehicular chassis.

In particular, the present invention includes a tower, a vehicular chassis including a base mounted thereon in movable disposition relative thereto, and a cross-linking member including a pair of elongate arms pivotally joined intermediate respective lengths thereof and extending between and connecting together the tower and the base.

In features of the present invention, the tower includes a ladder section and a platform section connected to the ladder section in movable disposition between a first position, in which the platform section and the ladder section are generally parallel, and a second position, in which the platform section and the ladder section are generally orthogonal. The base itself includes a turntable mounted on the vehicular chassis for rotation about a vertical axis thereof relative to the vehicular chassis, and a tiltable frame mounted on the turntable that pivots relative to the vehicular chassis through an angle of approximately ninety degrees.

In another feature of the present invention, the apparatus includes a catwalk that extends between the base and the tower.

In a preferred embodiment of the present invention, each arm of the cross-linking member includes an end that is slidably mounted on the ladder section of the tower with one of the ends further being fixedly mounted to an exterior of an extendable actuator mounted to the ladder section. Additionally, one of these arms includes an end that is slidably mounted on the tiltable frame and the other arm includes an end that is mounted at a fixed location on the tiltable frame. A first cylinder is connected to the tiltable frame and to the cross-linking member such that the tower moves between a retracted position and an extended position relative to the tiltable frame by extension and retraction of the first cylinder. A second cylinder is connected to the ladder section whereby the ladder section slidably moves between upper and lower positions relative to the ends of the arms of the cross-linking member mounted on the tower by extension of the second cylinder. Also in this preferred embodiment, the catwalk includes a first walkway mounted in fixed disposition against movement relative to the tiltable frame and a second walkway mounted to the end of the second arm slidably mounted to the ladder section, whereby the first walkway and the second walkway move linearly relative to each other during lateral adjustment of the tower relative to the vehicular chassis.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
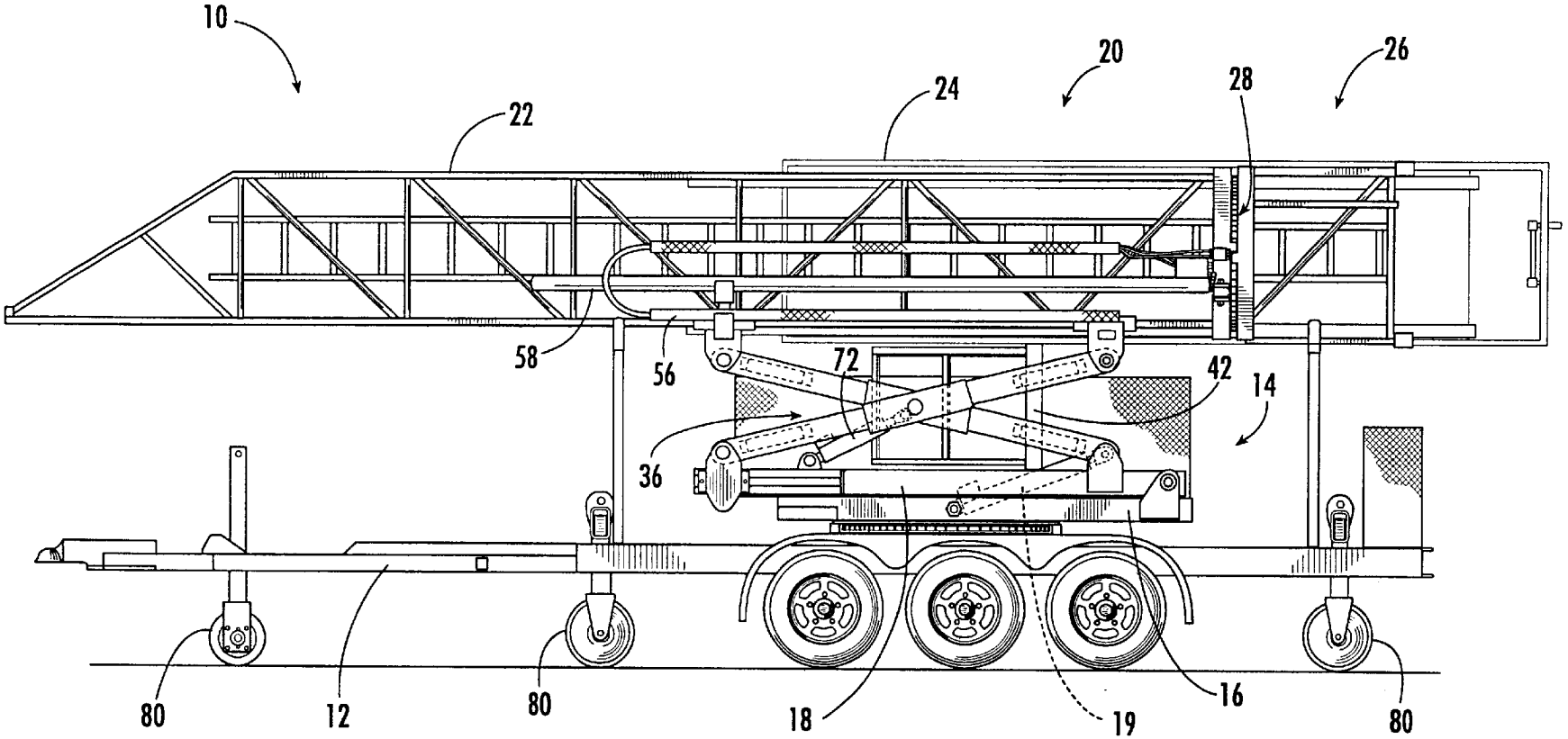
FIG. 1 is an elevational view of a side of a first preferred embodiment of the under bridge access apparatus in accordance with the present invention.
Figure 2:
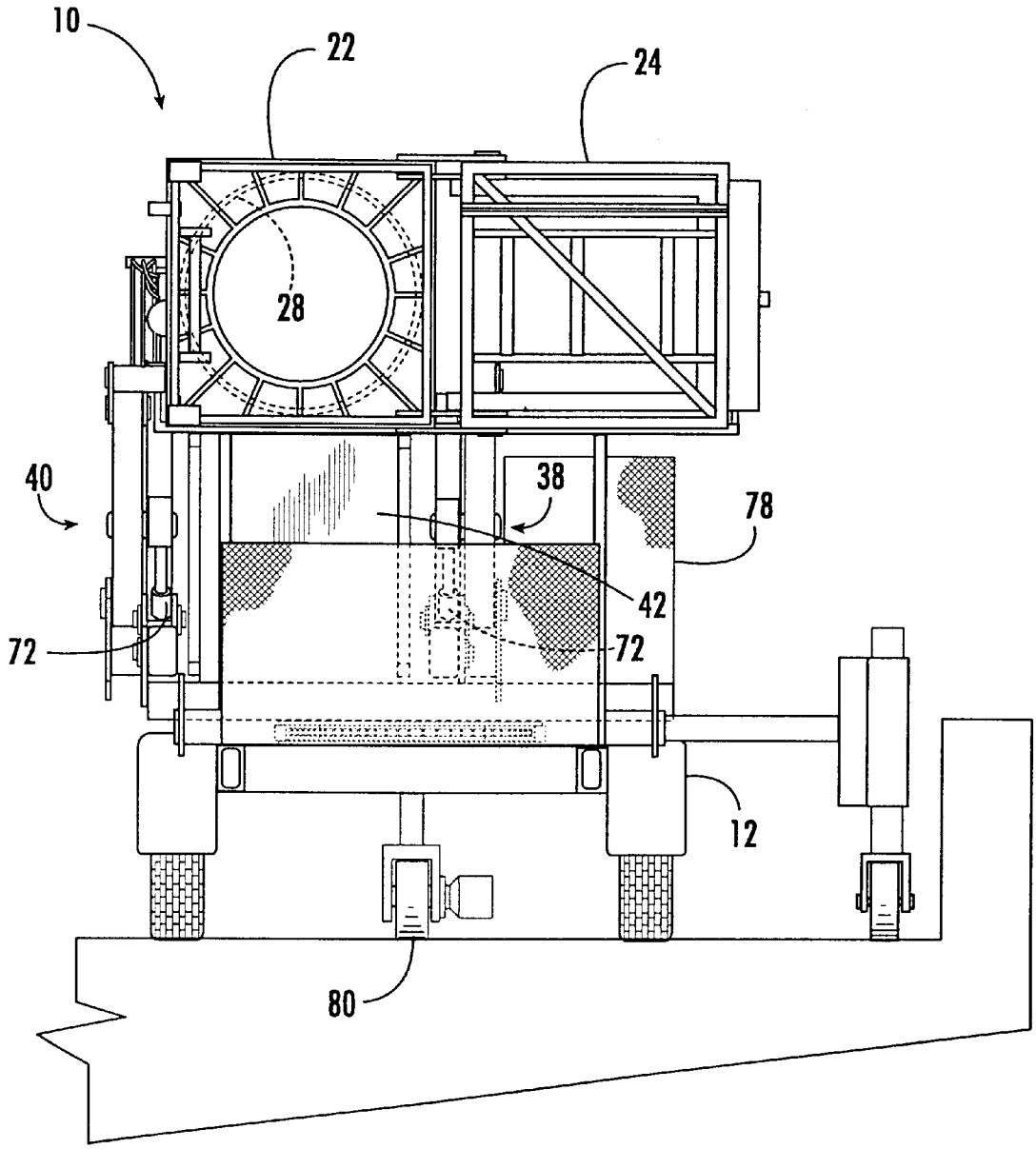
FIG. 2 is an elevational view of a rear of the under bridge access apparatus of FIG. 1.

Referring now to the drawings, a first preferred embodiment 10 of the under bridge access apparatus in accordance with the present invention is shown in FIGS. 1–2 in a compactly retracted storage/transport position. The under bridge access apparatus is hydraulically actuated and unfolds into the operational position shown in FIG. 8, wherein a worker can readily gain access to the underside of a bridge for maintenance, repair, or inspection. Successive intermediate positions between the retracted storage/transport position of FIGS. 1–2 and the operational position of FIG. 8 are illustrated in FIGS. 3–7, and are discussed in detail below with regard to the operation of the apparatus.

However, turning first to the components of the apparatus, and with reference to FIGS. 1–8, the first preferred under bridge access apparatus 10 includes a vehicular chassis 12 comprising a trailer. A base 14 is mounted on the vehicular chassis 12 and includes a generally horizontal turntable 16 that is rotatable about a vertical axis thereof. The base 14 additionally includes a tiltable frame 18 that is mounted to the turntable 16 and that pivots relative thereto through actuation of hydraulic cylinders 19 that extend between and connect the turntable 16 with the tiltable frame 18.

This preferred under bridge access apparatus 10 also includes a tower 20 comprising a ladder section 22 and a platform section 24. The platform section 24 is mounted to an end 26 of the ladder section 22 and pivots relative thereto between a first position generally parallel with the ladder section 22 and a second position generally orthogonal to the ladder section 22. The end 26 of the ladder section 22 additionally is rotatably mounted at 28 to the remainder of the ladder section 22. A hydraulic cylinder 30 extends between and is connected to the platform section 24 and the ladder section 22 for controlling the pivoting movement of the platform section 24. The platform section 24 further includes a platform extension 32 that is slidable between a retracted position, in which the platform extension 32 telescopes under the platform section 24, and an extended position, in which the platform extension 32 extends beyond the platform section 24 to thereby increase the length of the platform section 24. A hydraulic cylinder 34 extends between and is connected to the platform section 24 and the platform extension 32 for controlling the slidable movement of the platform extension 32 relative to the platform section 24.

A cross-linking member 36 extends between and connects together the tower 20 and the tiltable frame 18 for support of the tower 20 by the vehicular chassis 12. The cross-linking member 36 includes two pair 38,40 of arms extending between and connecting together the tiltable frame 18 and the tower 20, each pair 38,40 of arms being disposed on opposite sides of a catwalk 42 (described in detail below). Each pair 38,40 of arms includes first and second arms 44,46 that are pivotally joined together intermediate lengths thereof at 48. Furthermore, each arm 44,46 extends the length thereof between and is pivotally mounted to opposed ends thereof.

With particular regard to each pair 38,40 of cross-linking arms, the first arm 44 of each pair 38,40 includes a lower end 50 mounted at a fixed location on the tiltable frame 18 and an upper end 52 slidably mounted to the ladder section 22 of the tower 20 as well as fixedly mounted against movement to a housing 54 of a respective hydraulic cylinder 56, the piston 58 of which is mounted to the ladder section 22 of the tower 20. The second arm 46 of each pair 38,40 includes an upper end 60 slidably mounted to the tiltable frame 18 and a lower end 62 slidably mounted to the ladder section 22. In particular, each end 52,62 that is slidably mounted to the tower 20 defines a channel 64 through which a guide bar 66 mounted on the ladder section 22 extends for effecting said slidable mounting. Likewise, the upper end 60 of the second arm 46 of each pair 38,40 also defines a channel 68 through which a guide bar 70 mounted on the tiltable frame 18 extends for effecting said slidable mounting thereof to the tiltable frame 18. Each of a pair of hydraulic cylinders 72 extends between and is connected to the tiltable frame 18 and a respective second arm 46 of the cross-linking member 36.

The apparatus also includes the aforementioned catwalk 42 which extends between the tiltable frame 18 and the tower 20. The catwalk 42 includes first and second walkways 74,76. The first walkway 74 is mounted to the tiltable frame 18 against movement relative thereto, and the second walkway 76 is mounted to the lower ends 62 of the second arms 46 and is fixed against movement relative thereto. Furthermore, the second walkway 76 telescopes under the first walkway 74 so as to maintain a continuous catwalk surface extending between the tiltable frame 18 and the tower 20.

A conventional motor arrangement 78 is carried on the vehicular chassis 12 for driving selected actuation of each of the aforementioned hydraulic cylinders for control of the folding and unfolding of the preferred under bridge access apparatus 10, as will now be described in detail below.

Figure 3:
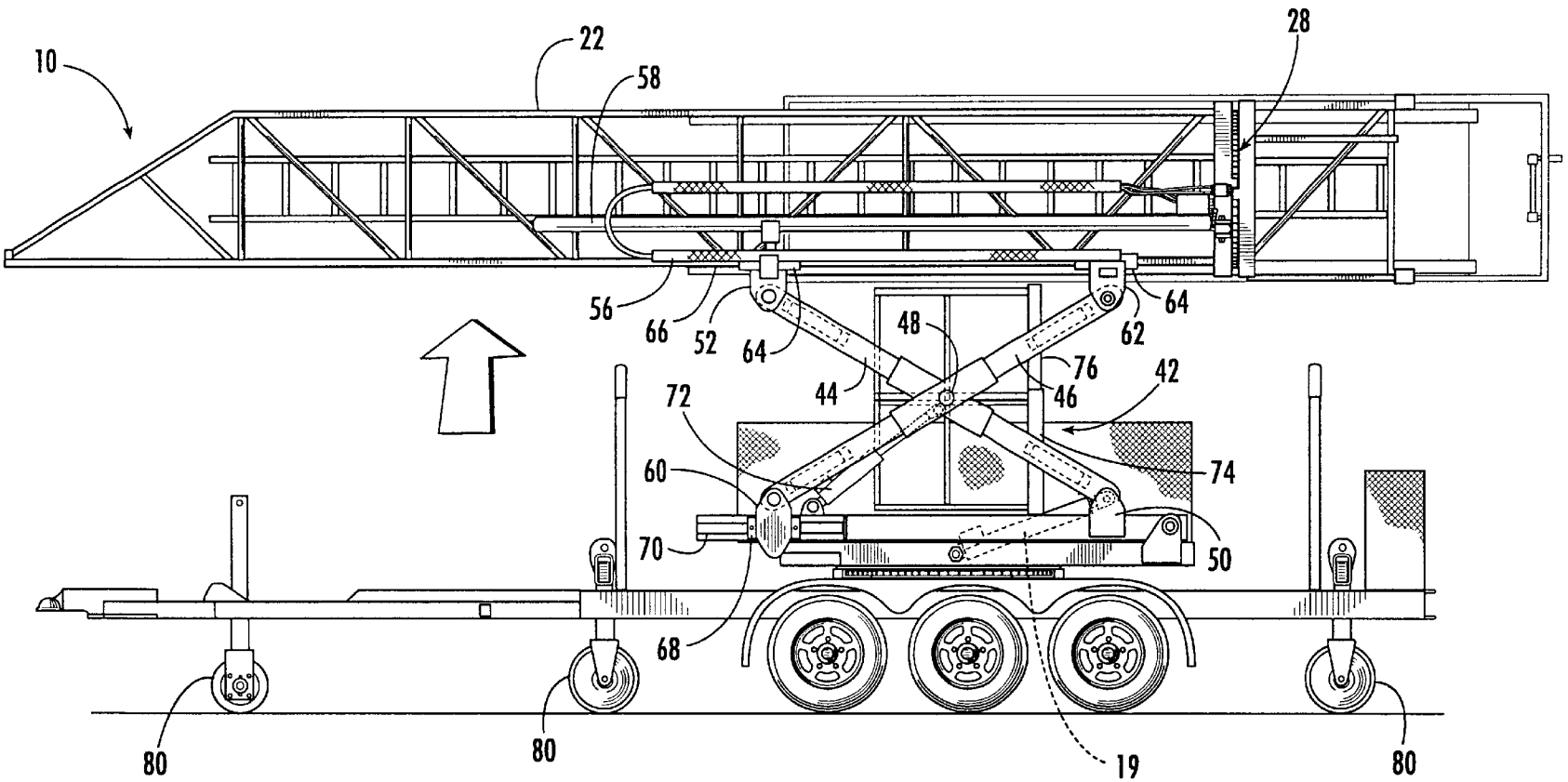
FIG. 3 is another elevational view of the side of the under bridge access apparatus of FIG. 1 in a first intermediate position.

Initially, to unfold the under bridge access apparatus 10 from the compactly retracted storage/transport position of FIGS. 1–2 into the operational position of FIG. 8, the hydraulic cylinders 72 connecting the cross-linking member 36 to the tiltable frame 18 are extended to raise the tower 20 vertically upward relative to the tiltable frame 18 and vehicular chassis 12, as shown in FIG. 3. Of course, prior to initiating such step, stabilizer jacks 80 should be extended and lowered into engagement with the road surface.

During the raising of the tower 20, the second walkway 76 mounted to the second arms 76 linearly extends upward relative to the first walkway 74 to adjust the length of the catwalk 42 to correspond to the distance between the tiltable frame 18 and the tower 20. It should also be noted that the upper end 60 of each second arm 46 of the pair 38,40 of arms remains in fixed position relative to the ladder section 22, relative movement therebetween only occurring as a result of actuation of the hydraulic cylinders 56.

Figure 4:
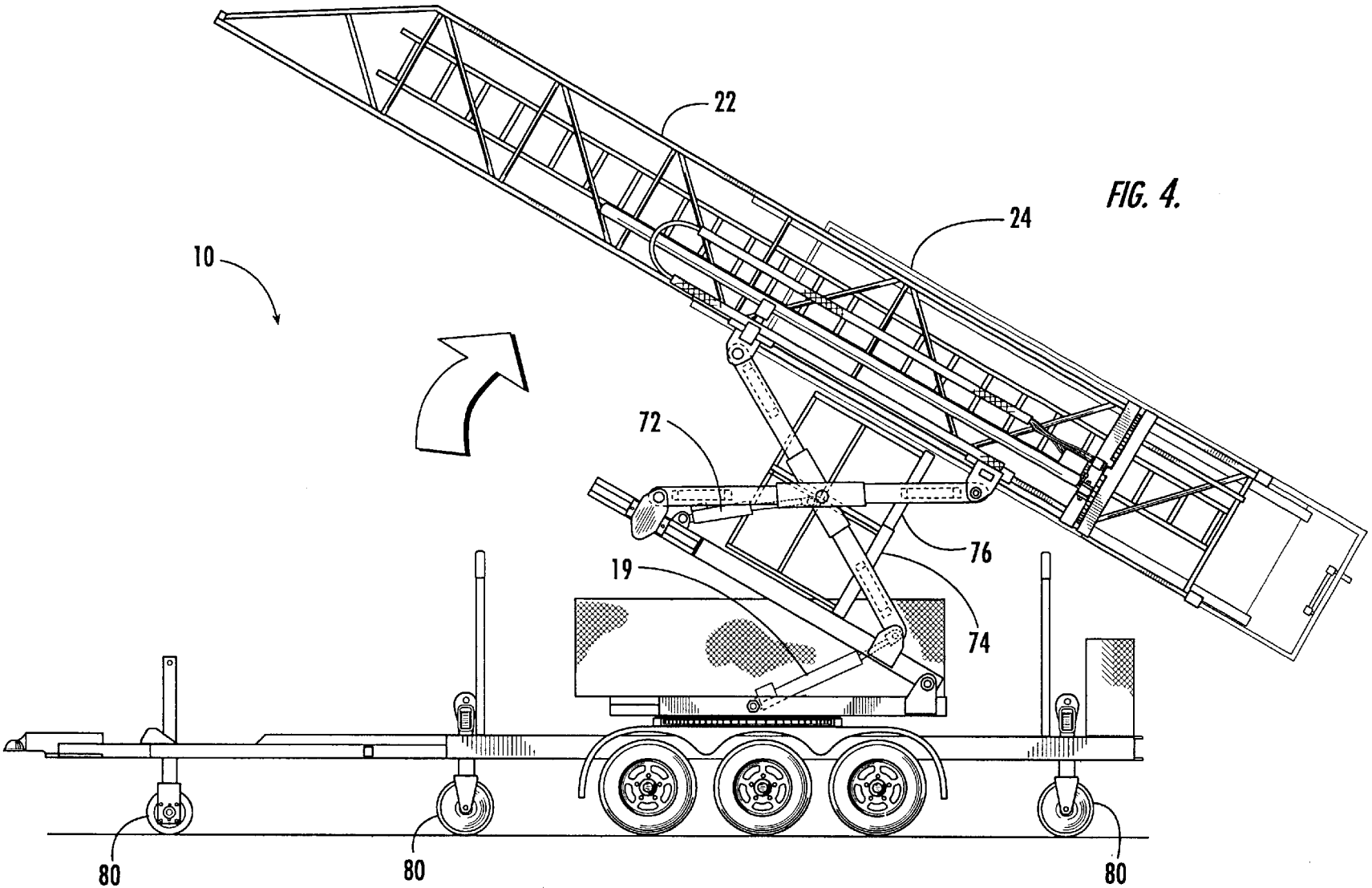
FIG. 4 is a third elevational view of the side of the under bridge access apparatus of FIG. 1 in a second intermediate position.
Figure 5:
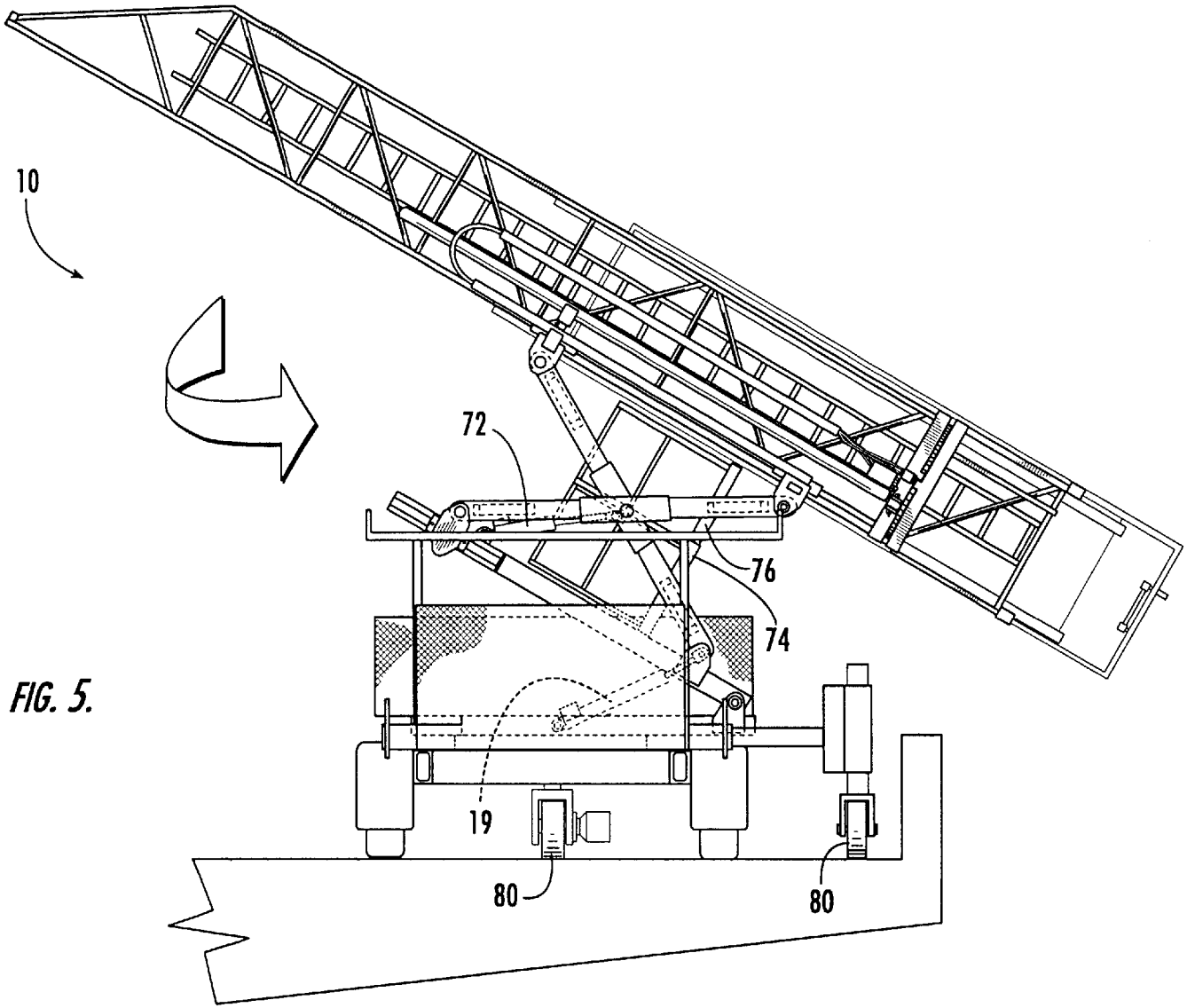
FIG. 5 is another elevational view of the rear of the under bridge access apparatus of FIG. 1 in a third intermediate position.

Following extension of the cross-linking member 36 by the hydraulic cylinders 72, a turntable lock pin (not shown) is removed and the tiltable frame 18 then is pivoted by actuation of hydraulic cylinder 19 through an approximate angle of twenty-five degrees to bring the tower 20 into the position as shown in FIG. 4. Following the pivoting of the tiltable frame 18, the turntable 16 is rotated about the vertical axis through an angle of approximately ninety degrees to bring the lower end 26 of the tower 20 over the bridge barrier wall as shown in FIG. 5. The turntable lock pin is then reinstalled to prevent the turntable 16 from further, accidental rotation thereof.

Figure 6:
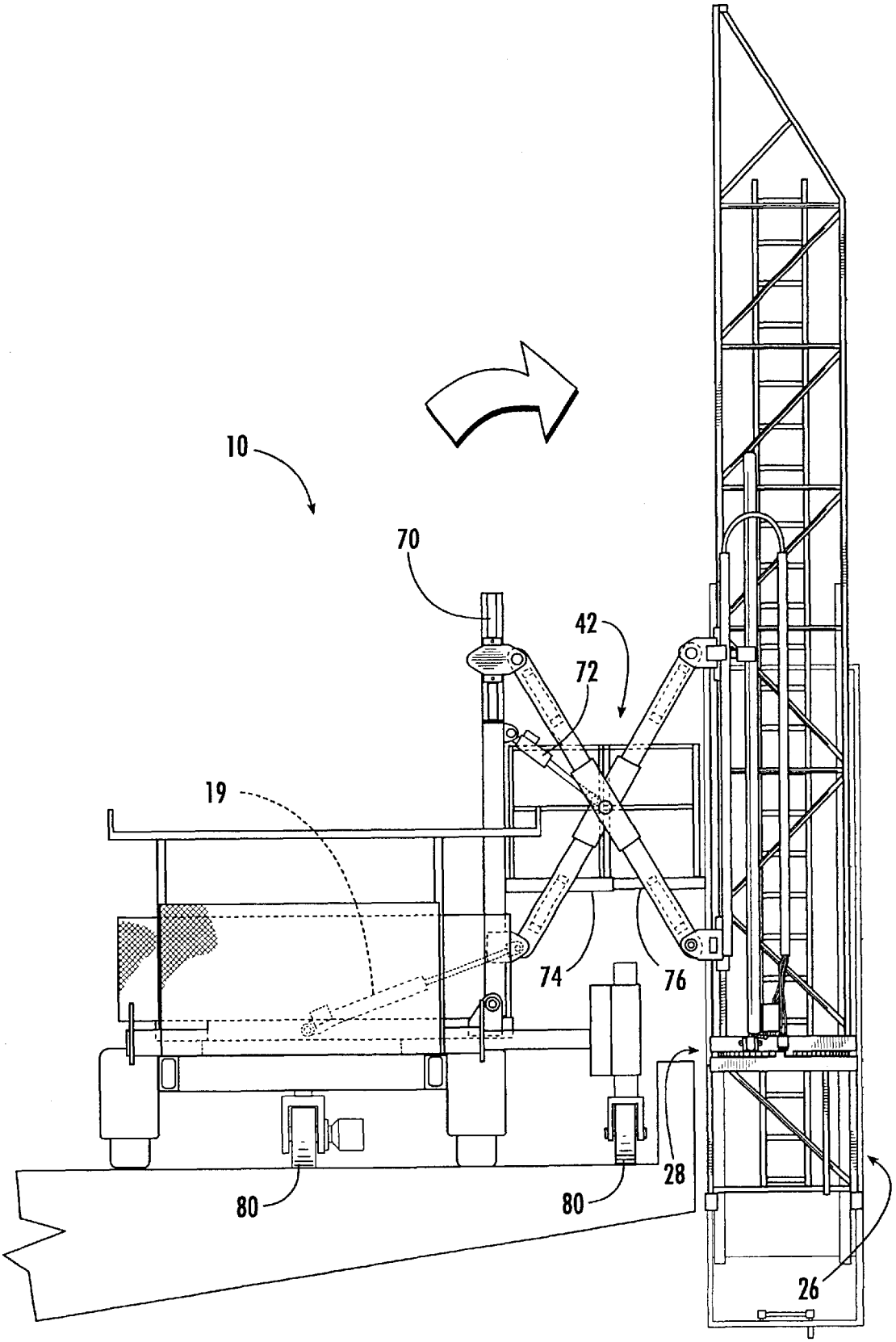
FIG. 6 is a third elevational view of the rear of the under bridge access apparatus of FIG. 1 in a fourth intermediate position.

Subsequently, pivoting of the tiltable frame 18 is continued to bring the tower 20 into a vertical orientation with the cross-linking member 36 extending generally orthogonal to the vehicular chassis 12 as shown in FIG. 6 (the vehicular chassis 12 having been aligned generally parallel with the bridge barrier wall). In this position, the tower 20 extends transverse to the bridge surface and the catwalk 42 extends generally horizontally between the tiltable frame 18 and the tower 20. The cross-linking member 36 is then adjusted by either retraction of the hydraulic cylinders 72 in order to bring the tower 20 into closer proximity to the side edge of the bridge. Importantly, during such adjustment the horizontal orientation of the catwalk 42 does not change, but only the length thereof resulting from the linear movement of the first and second walkways 74,76 relative to each other. Specifically, the lower ends 50,62 of the first and second arms 44,46 of each pair 38,40 remain at the same vertical height during extension and retraction of the cross-linking member 36 and, accordingly, the vertical height of the first and the second walkways 74,76 remains the same, too.

Figure 7:
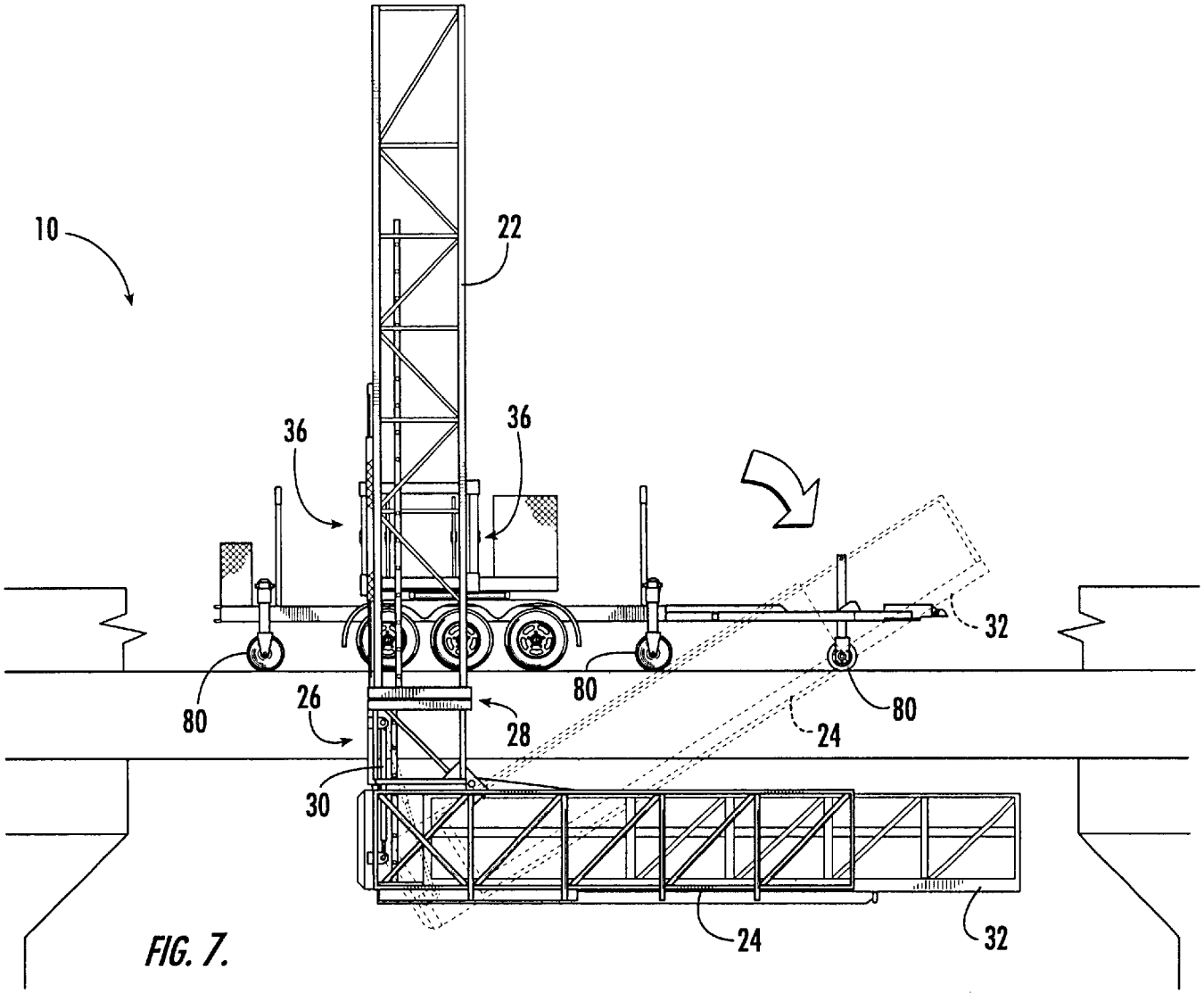
FIG. 7 is an elevational view of another side of the under bridge access platform of FIG. 1 in a fifth intermediate position.
Figure 8:
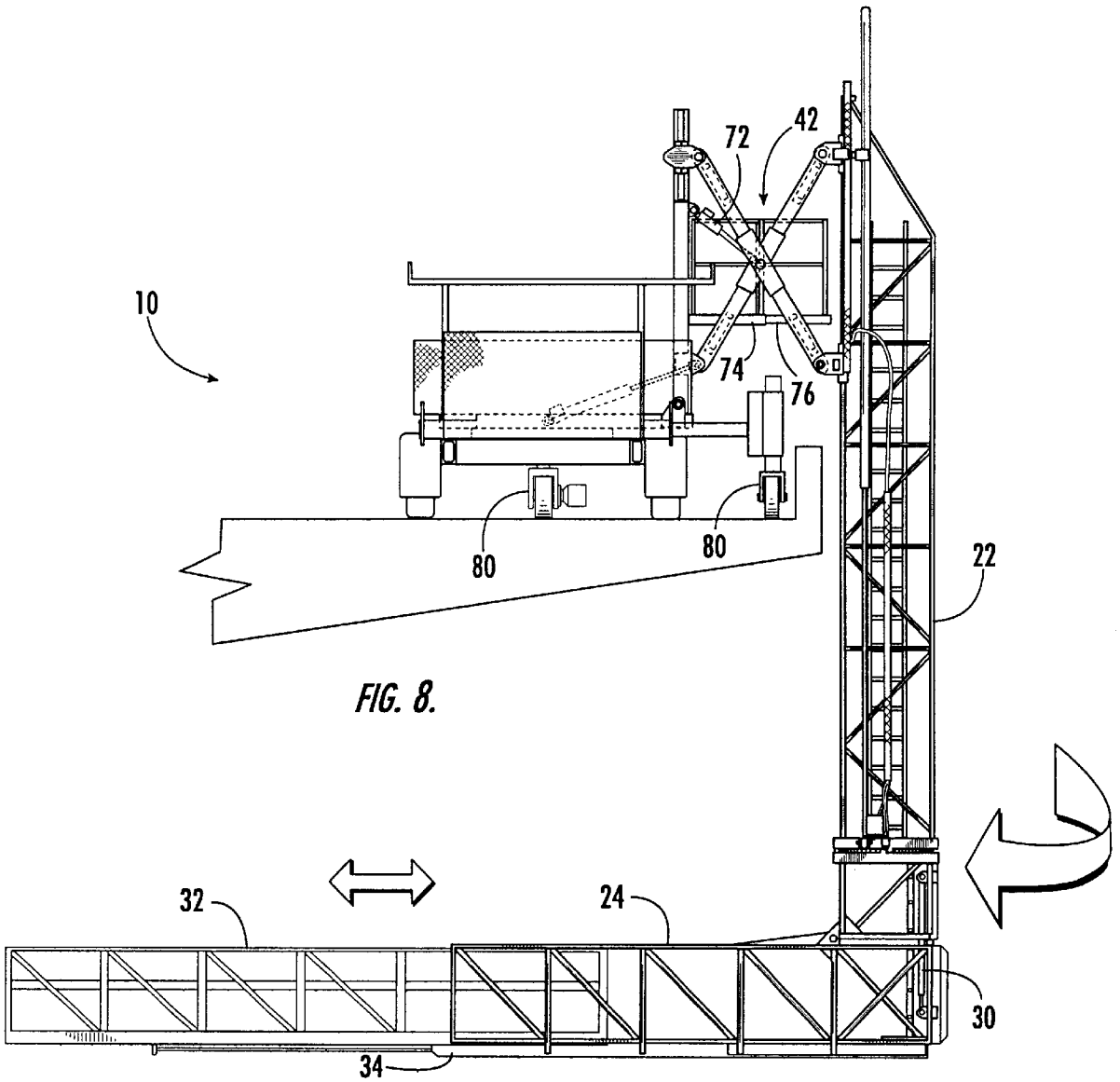
FIG. 8 is a fourth elevational view of the rear of the under bridge access platform of FIG. 1 in a sixth fully-extended position.

Next, the platform section 24, until this point maintained in a generally parallel orientation relative to the ladder section 22, is lowered by extension of hydraulic cylinder 30 by pivoting of the platform section 24 into an orthogonal position relative to the ladder section 22 as shown in FIG. 7. Next, the ladder section 22 is lowered by actuation of hydraulic cylinders 56, the guide bars 66 mounted to the ladder section 22 sliding through the channels 68 formed in ends 52,62 of the first and second arms 44,48, and then the platform section 24 is rotated with the end 26 of the ladder section 22 relative to the remainder of the ladder section 22 through an angle of approximately ninety degrees to bring the platform section 24 underneath the bridge. The platform extension 32 is also slidably extended from underneath of the platform section 24 to extend the length of the platform section 24 further under the bridge from the side thereof by actuation of hydraulic cylinder 34, resulting in the operational position of the apparatus shown in FIG. 8.

As will be apparent to one having ordinary skill in the art, the positioning of the platform section 24 in the operational position can be adjusted by selective rotation of the end 26 of the ladder section 22; by raising or lowering the ladder section 22 through hydraulic cylinders 56; and further, by moving the tower 20 toward and away from the side of the bridge by selective extension or retraction of the cross-linking member 36, as necessary. In this regard, during each type of adjustment, including the selective extension or retraction of the cross-linking member 36, the catwalk 42 extending between the tower 20 and the tiltable frame 18 remains generally horizontal at all times and is not subject to the extreme pitches encountered in conventional under bridge access apparatus. Accordingly, the preferred under bridge access apparatus as described above provides the additional, important benefit over other state-of-the-art apparatus, such as that disclosed in Moog U.S. Pat. No. 5,253,731, of the ability to extend the tower 20 both toward and away from the vehicular chassis 12 to clear pedestrian sidewalks and other obstacles while maintaining the catwalk 42 generally horizontal at all times. The safety of workers who must crossover the catwalk 42 in order to reach and descend the ladder section 22 of the tower 20 is thereby safeguarded.

Figure 9:
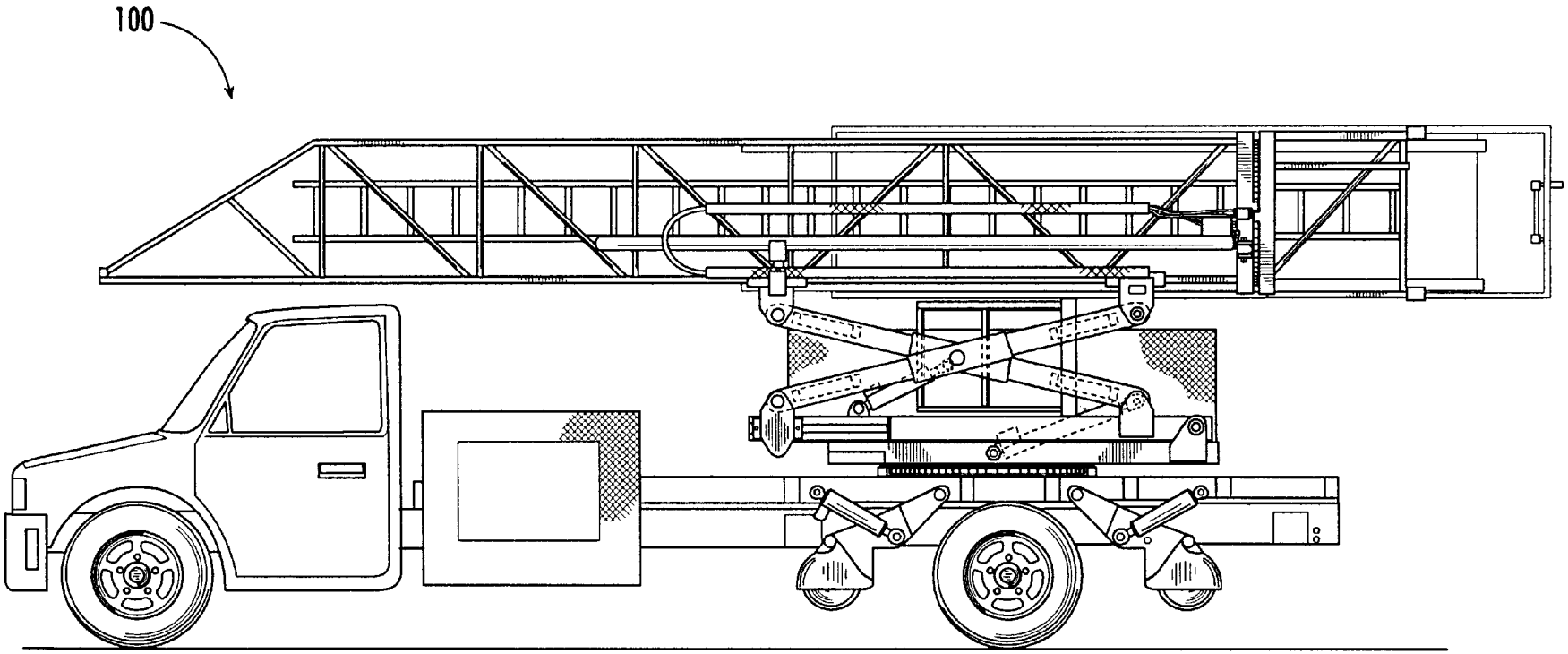
FIG. 9 is an elevational view of a side of a second preferred embodiment of the under bridge access apparatus in accordance with the present invention.

Yet another preferred embodiment 100 of the present invention is illustrated in FIG. 9, and differs from the first preferred embodiment 10 essentially only in the provision of a truck rather than a trailer for the vehicular chassis 12.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

For example, it is within the scope of the present invention to modify the preferred embodiments such that the mounting of the ends of the first arms to the tiltable frame are switched with the mounting of the ends of the second arms to the tiltable frame. In this case, it is preferred that the first walkway of the catwalk remain mounted to the tiltable frame fixed against movement relative thereto, and that the second walkway be mounted to the upper ends of the first arms and fixed against movement relative thereto. In yet another covered example, the lower ends of the second arms, rather than the upper ends of the first arms, are additionally mounted to the housings of the hydraulic cylinders connecting the ladder section to the cross-linking member.

What is claimed is:

1. An under bridge access apparatus, comprising:

(a) a tower;

(b) a vehicular chassis including a base mounted thereon that moves relative thereto;

(c) a cross-linking member including a pair of elongate arms pivotally joined intermediate respective lengths thereof and extending between and connecting together said tower and said base, wherein said tower moves between a travel position and a deployed position, the tower being generally horizontal and parallel to said vehicular chassis when said tower is in the travel position and being generally vertical and orthogonal to said vehicular chassis when said tower is in the deployed position, the cross-linking member selectively separating said tower from said base; and (d) a catwalk extending between said tower and said base, said catwalk compromising a first walkway mounted on and against movement relative to said base, and a second walkway mounted to said tower, the second walkway being telescopingly moveable relative to the first walkway during horizontal movement of said tower, wherein said tower is vertically adjustable relative to said cross-linking member and horizontally adjustable between a retracted position and an extended position relative to said base by corresponding horizontal movement of said cross-linking member when the tower is in the deployed position, the crosslinking member remaining essentially horizontal during movement thereof, and wherein the catwalk remains generally horizontal during horizontal and vertical movement of said tower when said tower is in the deployed position.

2. The under bridge access apparatus of claim 1, further comprising an extendable actuator connected to said base and to said cross-linking member for moving said tower horizontally relative to said base by extension and retraction of said extendable actuator.

3. The under bridge access apparatus of claim 1, wherein said tower moves between a retracted position and an extended position relative to said base, and wherein (i) a first arm of said pair of arms includes an end slidably mounted on said tower and a second arm of said pair of arms includes an end mounted at a fixed location on said tower such that said tower is slidably mounted to said end and said tower slidably moves relative to said end during said extension of said tower, and (ii) the first arm of said pair of arms includes another end slidably mounted on said base, and the second arm of said pair of arms includes another end mounted at a fixed location on said base, each said arm of said pair of arms extending between and being pivotally connected to respective said ends thereof.

4. The under bridge access apparatus of claim 1, wherein said tower moves between a retracted position and an extended position relative to said base, and wherein (i) a first arm of said pair of arms includes an end mounted at a fixed location on said base and another end mounted at a fixed location on said tower during said extension of said tower, and (ii) a second arm of said pair of arms includes an end slidably mounted on said base and another end slidably mounted on said tower, each said arm extending between and being pivotally connected to respective said ends thereof.

5. The under bridge access apparatus of claim 4, wherein said end of said first arm of said pair of arms mounted on said tower is movably connected to said tower by an extendable actuator, such that said tower moves relative to the cross-link member.

6. The under bridge access apparatus of claim 1, wherein (i) each said arm of said pair of arms includes an end that is slidably mounted on said tower, and (ii) one of said arms of said pair of arms includes an end that is slidably mounted on said base, and the other of said arms of said pair of arms includes an end that is mounted at a fixed location on said base, each said arm extending between and being pivotally connected to respective said ends thereof.

7. The under bridge access apparatus of claim 6, wherein one of said arms slidably mounted on said tower is further movably connected to said tower by an extendable actuator whereby said tower moves relative to the cross-link member by extension and retraction of the extendable actuator.

8. The under bridge access apparatus of claim 6, wherein one of said ends of each said arm includes a guide channel through which said tower extends for slidably mounting of said arm thereto.

9. The under bridge access apparatus of claim 1, wherein said base includes a turntable and a tiltable frame mounted thereon that pivots relative thereto.

10. The under bridge access apparatus of claim 1, wherein said tower includes a ladder section, and a platform section connected to said ladder section and that moves between a first position, in which said platform section and said ladder section are generally parallel, and a second position, in which said platform section and said ladder section are generally orthogonal.

11. The under bridge access apparatus of claim 10, wherein said platform section includes a platform extension slidable between a retracted position, in which said platform extension telescopes under said platform section, and an extended position, in which said platform extension extends beyond said platform section to thereby increase the length of said platform section.

12. The under bridge access apparatus of claim 10, further comprising an extendable actuator connected to said ladder section and said cross-linking member such that said ladder section slides between first and second positions relative to said cross-linking member by extension of said actuator.

13. The under bridge access apparatus of claim 1, wherein said base includes a turntable mounted on said vehicular chassis for rotation about a vertical axis thereof relative to said vehicular chassis, and a tiltable frame mounted on said turntable that pivots relative to said vehicular chassis, said cross-linking member being, mounted to said tiltable frame.

14. The under bridge access apparatus of claim 13, wherein said tiltable frame pivots through approximately ninety degrees.

15. The under bridge access apparatus of claim 13, wherein the first walkway is mounted to said tiltable frame in fixed location relative thereto, and the second walkway is mounted to said cross-linking member.

16. The under bridge access apparatus of claim 15, wherein said tower moves horizontally relative to said base, and wherein (i) a first arm of said pair of arms includes an end mounted at a fixed location on said base and another end mounted at a fixed location on said tower during said extension of said tower, (ii) a second arm of said pair of arms includes an end slidably mounted on said base and another end slidably mounted on said tower, each of said first and second arms extending between and being pivotally connected to respective said ends thereof, (iii) said first walkway is mounted on and against movement relative to said tiltable frame, and (iv) said second walkway is mounted to said end of said second arm slidably mounted to said tower, such that said second walkway moves only linearly relative to said first walkway during extension and retraction of said cross-linking member when said tower is in the deployed position, whereby said catwalk remains substantially horizontal during extension and retraction of said cross-linking member.

17. An under bridge access apparatus, comprising:

(a) a tower including a ladder section, and a platform section connected to said ladder section and that moves relative thereto;

(b) a vehicular chassis including a turntable mounted on said vehicular chassis for rotation about a vertical axis thereof relative to said vehicular chassis, and a tiltable frame mounted on said turntable that pivots relative to said vehicular chassis;

(c) a cross-linking member including a pair of elongate arms pivotally joined intermediate respective lengths thereof and extending between and connecting together said tiltable frame and said tower, a first arm of said pair of arms including an end mounted at a fixed location on said tiltable frame and another end slidably mounted on said ladder section, a second arm of said pair of arms including an end slidably mounted on said tiltable frame and another end slidably mounted on said ladder section, each of said first and second arms extending between and being pivotally connected to respective said ends thereof, wherein the cross-linking member moves between a first position, in which the cross-linking member extends vertically relative to said chassis, and a second position, in which the cross-linking member extends orthogonally relative to said chassis;

(d) a first cylinder connected to said tiltable frame and to said cross-linking member such that said tower moves between a retracted position and an extended position relative to said tiltable frame by extension and retraction of said first cylinder;

(e) a second cylinder connected to said ladder section and said end of said first arm of said pair of arms slidably mounted to said tower such that said ladder section slides between upper and lower positions relative to said cross-linking member by extension and retraction of said second cylinder; and (f) a catwalk extending between said tower and said base, said catwalk including a first walkway mounted on and against movement relative to said tiltable frame, and a second walkway mounted to said end of said second arm of said pair of arms slidably mounted to said ladder section, such that said second walkway moves only linearly relative to said first walkway during extension and retraction of said cross-linking member whereby said catwalk remains generally horizontal during the extension and retraction of said cross-linking member when said cross-linking member is in said second position.

18. An under bridge access apparatus comprising a tower connected to a base mounted on a vehicular chassis by a cross-linking member, the tower being adjustable by movement of the cross-linking member along a distance between a retracted position wherein the tower is proximate to the base and an extended position wherein the tower is at a maximum distance from the base, such that the tower is deployable on bridges having structures that impede the placement of the vehicular chassis adjacent to an edge of the bridge, and further comprising a catwalk having a first walkway mounted on and against movement relative to said base and a second walkway mounted to said tower, said second said tower such that the catwalk remains generally horizontal during movement thereof.

* * * * *